US005812173A

United States Patent [19]

Gilbert et al.

[11] Patent Number: 5,812,173

[45] Date of Patent: Sep. 22, 1998

[54] THERMAL TRANSFER PRINTING

[75] Inventors: Keith William Gilbert; Ian Richard Stephenson, both of Ipswich, United Kingdom

[73] Assignee: Imperial Chemical Industries PLC, United Kingdom

[21] Appl. No.: 663,039

[22] PCT Filed: Dec. 13, 1994

[86] PCT No.: PCT/GB94/02724

§ 371 Date: Jun. 11, 1996

§ 102(e) Date: Jun. 11, 1996

[87] PCT Pub. No.: WO95/16571

PCT Pub. Date: Jun. 22, 1995

[30] Foreign Application Priority Data

Dec. 15, 1993 [GB] United Kingdom ..... 9325611

[51] Int. Cl.[6] ..... B41J 2/325; B41J 2/475; B41J 2/48

[52] U.S. Cl. ..... 347/176; 347/224; 347/217

[58] Field of Search ..... 347/214, 217, 347/172, 173, 174, 176, 224, 262, 264

[56] References Cited

U.S. PATENT DOCUMENTS

| | | | |
|---|---|---|---|
| 4,611,217 | 9/1986 | Iizuka et al. | 347/176 |
| 5,017,547 | 5/1991 | DeBoer | 503/227 |
| 5,341,157 | 8/1994 | Campagna et al. | 347/264 |
| 5,450,117 | 9/1995 | Quanz | 347/217 |

FOREIGN PATENT DOCUMENTS

| | | | |
|---|---|---|---|
| 60-139470 | 7/1985 | Japan | 347/172 |
| A 62-007 590 | 1/1987 | Japan . | |
| A 2 069 160 | 8/1981 | United Kingdom . | |
| A 2 210 585 | 6/1989 | United Kingdom . | |

OTHER PUBLICATIONS

R.J. von Gutfeld, "Layered Structure For Decreasing Laser Energy For Beam–Addressable Memory", IBM Technical Disclosure Bulletin, vol. 16, No. 2 Jul. 1973 pp. 498–499.

Nash et al., "Ink Barrier For A Multicolor Printer Ribbon", IBM Technical Disclosure Bulletin, vol. 27, No. 3 Aug. 1984, p. 1824.

*Primary Examiner*—Huan H. Tran

[57] ABSTRACT

Dye diffusion thermal printing method and apparatus, particulary for the preparation of 35 mm format slides using a laser as the source of thermal stimulii, in which each successive dye coat of a dye ribbon on which the dye coats are in the form of stripes extending along the longitudinal axis of the ribbon, is brought into register with a receiver sheet by effecting relative transverse movement between the ribbon and the receiver sheet.

5 Claims, 2 Drawing Sheets

THERMAL TRANSFER PRINTING

FIELD OF THE INVENTION

BACKGROUND OF THE INVENTION

This invention relates to dye diffusion thermal transfer printing.

Dye diffusion thermal transfer printing is a generic term for processes in which one or more thermally transferable dyes are caused to transfer from a dye sheet to a receiver sheet in response to thermal stimuli. Using a dye sheet comprising a thin substrate supporting a dye coat containing one or more such dyes uniformly spread over an entire printing area of the dye sheet, printing can be effected by heating selected discrete areas of the dye sheet whilst the dye coat is pressed against a receiver sheet. The shape of the pattern transferred is determined by the number and location of the discrete areas which are subject to heating. Complex images can be built up from large numbers of very small pixels placed close together, the resolution of the final image being determined by the number, size and spacing of such pixels. Full colour prints can be produced by printing with different coloured dye coats sequentially in like manner. Usually, the dye sheet is In the form of a ribbon with the different coloured dye coats being in the form of discrete panels or stripes transverse to the axis of the ribbon in a repeated sequence along the ribbon, printing of the three colours being effected by moving the dye ribbon axially relative to the receiver sheet and whatever means are used to generate the thermal stimuli.

The thermal stimuli may be produced by a thermal printing head having a matrix of tiny heating elements (typically six or more to the millimeter) which are selectively energisable to transfer individual pixels. By programming the printing head to respond to electronic signals representing monochrome or full colour images (eg from a video camera, electronic still camera or computer), hard copies of those images can be produced. Alternatively, the thermal stimuli can be produced by means of a laser beam which is scanned across the dye coat in a raster pattern, the intensity of the beam being modulated in accordance with the aforesaid electronic signals to transfer the individual pixels. Use of a laser allows much greater resolution which is particularly important in respect of the use of thermal printing to prepare 35 mm slides (or transparencies) as an alternative to the conventional photographic method.

Conventionally, the dye coats are applied by gravure coating and as is well known, gravure coating relies on a roller the surface of which has been etched to provide a pattern of cells which pick up and transfer the coating and which inherently produce variations in the thickness of the dye coat which can cause variations in the optical density of the transferred image. Normally this is of little importance as such variations are invisible to the eye.

However, 35 mm slides can, of course, be magnified by a factor of 50 or more during projection and at this degree of magnification any variation caused by the cell pattern would be a serious drawback.

Moreover, for slide preparation it is essential to have a high dye coat weight so that the high transmission optical density required in final prints can be achieved and such weights cannot easily be achieved by gravure coating.

Although a better quality coating (ie without cell patterns) of higher weight can be achieved using continuous coating methods such as bead coating, such methods cannot be used to produce conventional panelled dye sheets.

In WO/14581 an attempt is made to overcome the problem by coating the substrate longitudinally with the dye coats and then cutting the resulting dye sheet into strips which are joined end to end to form a conventional dye ribbon with transverse dye coats. However, this is a cumbersome operation and such dye ribbons would have an inherent physical weakness.

To simplify terminology, hereinafter dye ribbons on which the dye coats are in the form of stripes extending along the longitudinal axis of the ribbon will be referred to as longitudinal dye ribbons and those on which the dye coats extend at right angles to the longitudinal axis of the ribbon will be referred to as transverse dye ribbons.

SUMMARY OF THE INVENTION

It is an object of the invention to provide a method of and apparatus for, dye diffusion thermal printing which allows the use of a longitudinal dye ribbon.

In one of its broadest senses, this invention provides a method of dye diffusion thermal printing characterised in that each successive dye coat on a longitudinal dye ribbon is brought into register with a receiver sheet by effecting relative transverse movement between the ribbon and the receiver sheet.

In another of it broadest senses, this invention provides apparatus for dye diffusion thermal printing characterised by the provision of means for producing relative transverse movement between a longitudinal dye sheet and a receiver sheet.

According to one aspect of the present invention, there is provided a method of dye diffusion thermal printing comprising positioning a longitudinal dye ribbon so that a first dye coat overlies and is in contact with an area of receiver sheet to be printed, heating the dye coat so as to cause appropriate transfer of the dye, causing relative movement in a transverse direction between the dye ribbon and the receiver sheet so that a second dye coat overlies and is in contact with said area of the receiver sheet, heating the second dye coat so as to cause appropriate transfer of the second dye, repeating the above steps for any further dye coats and separating the dye ribbon from the receiver sheet.

According to a further aspect of the invention, there is provided a printing apparatus for dye diffusion thermal printing comprising means for producing thermal stimuli, means for positioning a longitudinal dye ribbon such that a first dye coat is heatable by the thermal stimuli, means for positioning an area of a receiver sheet in contact with said dye coat and means for causing relative movement in a transverse direction between the dye ribbon and said area of the receiver sheet.

According to a preferred aspect of the invention, the means for producing thermal stimuli is a laser and the apparatus contains means for causing the laser beam to move in a raster pattern.

The approximate dimensions of the image area of a normal 35 mm format slide are 36 mm×24 mm. There are circumstances in which it would be advantageous to be able to produce a slide having at least one of these dimensions increased. To achieve this result with a transverse dye ribbon would mean increasing either the width of the ribbon or the width of the dye coat. In either case, there would be wastage of dye coat when producing normal sized slides. In the method and apparatus of the invention, there is no such wastage as the length of dye ribbon used equates to the required dimension in the axial direction of the ribbon.

To enable the dye ribbon to be more easily inserted into the printing apparatus, the invention provides a cartridge/ cassette comprising a housing, a feed spool rotatably mounted in the housing and having wound thereon a longitudinal dye ribbon bearing at least two dye coats and a take-up spool rotatably mounted in the housing and having affixed thereto the free end of the ribbon.

As mentioned previously, it is important in the preparation of 35 mm slides that high optical densities are achieved and it is a further object of this invention to provide a dye ribbon which gives an improvement in this respect.

According to a further aspect of the invention, there is provided a longitudinal dye ribbon characterised by the provision of a reflective layer positioned such that laser light projected through the receiver sheet and not absorbed on the first pass through the dye sheet is reflected back so as to be absorbed on a second pass.

The reflective layer should have a reflectance at the wavelength of the laser light of at least 15 and preferably 50%.

The layer may be formed of any suitably reflective material, metals being particularly suitable with aluminium being preferred to others on the basis of cost, and may be applied by conventional means such as vapour deposition or sputtering.

The longitudinal ribbon may have the same constituents as conventional dye sheets. Thus the substrate may be, for example, polyester or poly vinyl chloride. Each dye coat may consist of one or more dyes of appropriate colour in a suitable binder resin such as polyvinyl butyral, polycarbonate or a cellulose such as hydroxyethyl cellulose. Where the thermal stimuli are provided by a laser, an absorber material capable of converting the laser light energy to thermal energy must be present. This absorber material may be in the dye coats themselves or may be in the form of a separate layer between the substrate and the dye coats.

For the preparation of 35 mm format slides, the coat weight of the dye coats preferably is greater than 1.0 $g/m^2$ and more preferably is 1.5 to 3.0 $g/m^2$.

To give full colour reproduction, the substrate carries at least a yellow, a cyan and a magenta dye coat, but additional coats, e.g. black may also be included.

BRIEF DESCRIPTION OF THE DRAWINGS

The invention will be more readily understood from the following description of a preferred embodiment taken in conjunction with the accompanying drawings in which.

DESCRIPTION OF THE PREFERRED EMBODIMENT(S)

Figure 1:
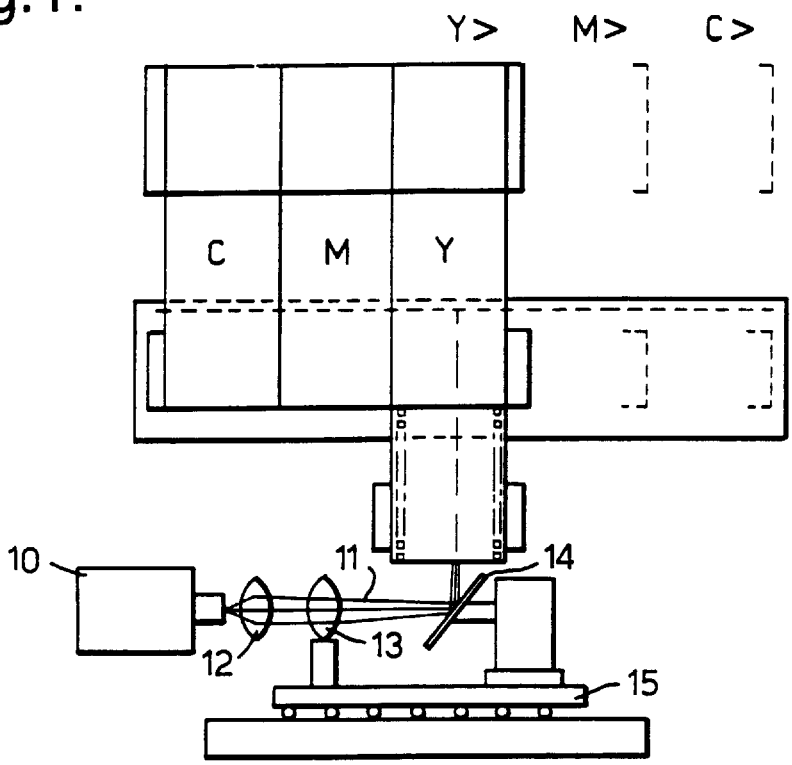
FIG. 1 is an end view of a schematic representation of a printing apparatus.

As shown in FIG. 1, a thermal printer comprises a laser device 10, the laser beam 11 from which, modulated in accordance with an appropriate information signal, is collimated by lenses 12 and 13 and directed at a galvanometer mirror 14 to produce a scanning movement in one dimension. The galvanometer and the lens 13 are mounted on travelling table 15, movement of which produces a scanning movement in a second dimension at right angles to the first, the two scanning movements giving a raster pattern.

Figure 2:
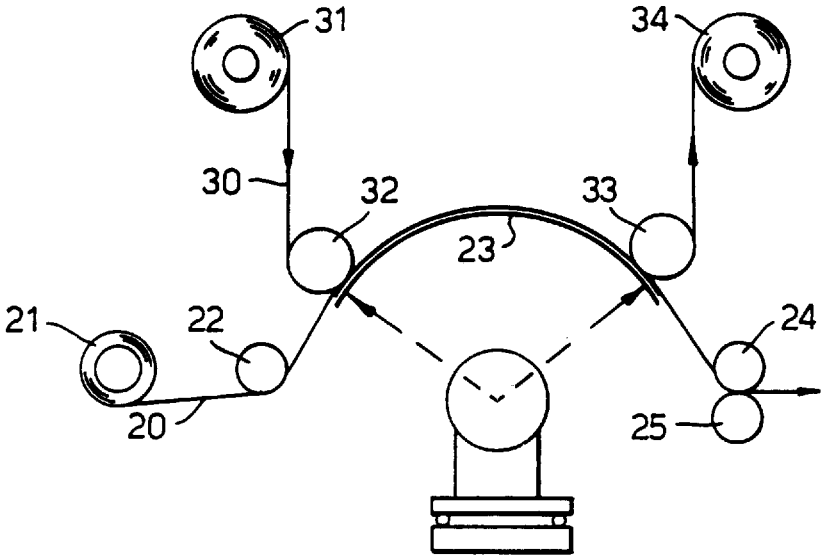
FIG. 2 is a side view of the apparatus shown in FIG. 1.

As shown in FIG. 2, a transparent receiver sheet in the form of a ribbon 20 extends from a supply spool 21, over a first tensioning roller 22 and a transparent arcuate member 23 and through a pair of nip rollers 24/25 to either a take-up spool or a cutting mechanism (not shown).

A longitudinal dye ribbon 30 having three dye coats containing respectively yellow, magenta and cyan dyes, extends from a feed spool 31, over a first pressure roller 32, the arcuate member 23 and a second pressure roller 33 to a take-up spool 34, the pressure rollers 32 and 33 maintaining the dye sheet in contact with the underlying receiver sheet. The dye ribbon, the feed and take-up spools and the pressure rollers form a dye ribbon assembly mounted so as to be movable in a direction transverse to the axis of the dye ribbon.

Figure 3:
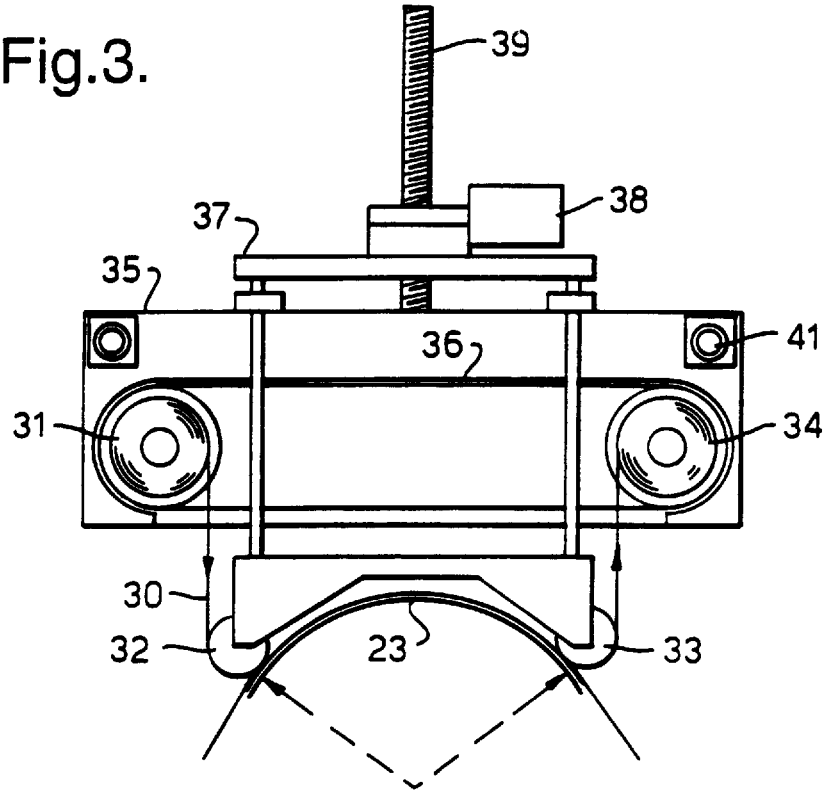
FIGS. 3 and 4 are more detailed views corresponding to FIGS. 1 and 2.
Figure 4:
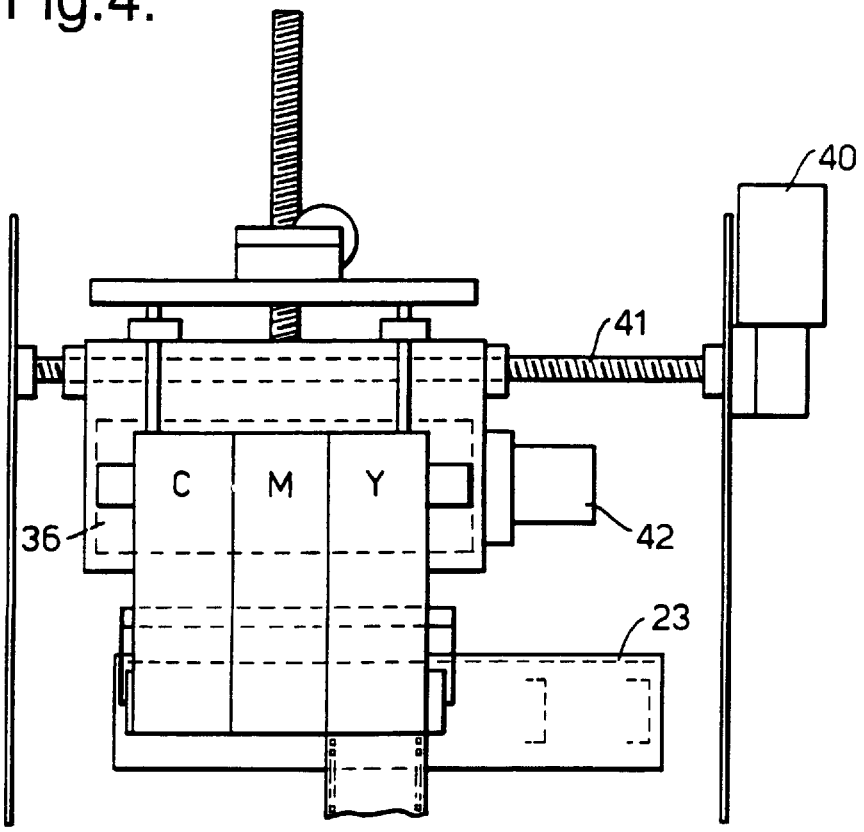

As shown in FIGS. 3 and 4, the dye ribbon assembly consists of a carriage 35 in which a cassette 36 containing the dye ribbon 30 and the feed and take-up spools 31 and 34 is mounted and a carriage 37 to the lower part of which the pressure rollers 32 and 33 are attached, the assembly being moved vertically by means of a motor 38 driving a lead screw 39 and horizontally by means of a motor 40 driving a lead screw 41.

To effect preparation of a slide, dye ribbon and receiver ribbon are withdrawn from the feed spools so that an area of the yellow dye coat overlies an area of the receiver ribbon on which the slide is to be printed and the dye ribbon assembly is lowered so that the pressure rollers 32 and 33 tension the dye ribbon and the receiver ribbon on the arcuate member 23 which is positioned so that the laser, after passing through the arcuate member and the transparent receiver ribbon is focused into the dye coat, and which has a radius such that the laser remains in focus whilst scanning without the necessity for compensating optics.

Under the control of appropriate signals, the laser beam is moved in a raster pattern, the intensity of the beam being modulated so as to locally heat the dye coat and cause dye transfer to the receiver sheet in the form of a pattern of pixels appropriate to the yellow content of the image to be produced.

Once the raster pattern is complete, the table 15 returns to its original position, the lead screw 39 is rotated to raise the dye ribbon assembly to release the tension and remove the dye ribbon from contact with the receiver ribbon and the lead screw 41 is rotated to move the dye ribbon assembly transversely until the magenta dye coat overlies the receiver sheet. The pressure rollers are re-applied by lowering the dye ribbon assembly and the process repeated to form a pattern of pixels appropriate to the magenta content of the image. The same process is carried out for the cyan and, if provided, the black dye coat.

Finally, the dye ribbon assembly returns to its original position and the dye ribbon and the receiver ribbon are moved longitudinally by means of motors driving the take-up spools (that for the dye ribbon being shown by 42 in FIG. 4) so that fresh areas are in position for the next slide to be prepared.

In an alternative embodiment, the dye ribbon assembly is fixed and the receiver ribbon assembly, the arcuate member and the laser assembly are mounted so as to be movable in a transverse direction.

The following non-limiting examples further illustrate the invention.

EXAMPLE 1

Dye coat solutions were made up according to the following formulations:

| Components (kg) | Yellow | Magenta | Cyan |
|---|---|---|---|
| Dye | 3.185 | 4.164 | 2.163 |
| Polyvinyl Butyral | 2.174 | 2.632 | |
| Ethyl Cellulose | 0.841 | 0.954 | 0.571 |
| Absorber | 0.638 | 0.657 | 2.163 |
| Tetrahydro-furan | 44 | 44 | 44 |

(The absorber is hexadeca-β-thionaphthalene copper(II) phthalocyanine).

These solutions were coated by direct gravure, by bead coating and by microgravure on to 2.6 μm thick polyester to give trichromat dye sheets.

A comparison of the coating weights achieved were made by measuring the optical densities using a Sakura densitometer. The results, given in the Table, show that the optical densities (and hence coating weights) achievable by the continuous coating bead and microgravure techniques are substantially higher than that attainable by direct gravure.

TABLE

| | Direct Gravure | Bead | Micro Gravure |
|---|---|---|---|
| Yellow | 3 | 3.9 | 3.4 |
| Magenta | 2.34 | 4.8 | 3.5 |
| Cyan | 1.72 | 3.7 | 3.0 |

The variation in optical density of the direct gravure and bead coated dye sheets was measured using a Joyce Loebel microdensitometer. In the case of the direct gravure dye sheet, there was an optical density variation of +/−0.7 over a pitch of 0.1 mm whereas in the case of the bead coated sheet, the same variation occurred over a pitch of 10 mm.

Further dye sheet samples were prepared using the above formulations and coating methods and then used to prepare slides. When projected at a magnification of 30 the effect of the variations was readily apparent in the projected image of the direct gravure dye sheet but was not discernible in either of the other dye sheets.

EXAMPLE 2

Dye sheet samples were prepared by bead coating the formulations of Example 1 on to polyester substrate which had been provided with a sputtered coating of aluminium to act as a reflective layer. Slides prepared using these samples were found to have a better optical density build-up and maximum than slides prepared from the samples without the reflective layer.

We claim:

1. A method of dye diffusion thermal printing for the production of 35 mm slides comprising positioning a longitudinal dye ribbon so that a first dye coat overlies and is in contact with an area of receiver sheet to be printed, heating the dye coat so as to cause appropriate transfer of the dye, causing the dye ribbon to move in a direction transverse to the receiver sheet so that a second dye coat overlies and is in contact with said area of the receiver sheet, heating the second dye coat so as to cause appropriate transfer of the second dye, and separating the dye ribbon from the receiver sheet, wherein the dye coat is heated by means of a laser and the dye ribbon comprises a substrate supporting two or more dye coats extending along the ribbon and a reflective layer interposed between the substrate and the dye coats such that laser light projected through the receiver sheet and not absorbed on a first pass through a dye coat is reflected back so as to be absorbed on a second pass.

2. A method according to claim 1 wherein the reflective layer has a reflectance of at least 15%.

3. Apparatus for dye diffusion thermal printing for the production of 35 mm slides comprising means for positioning an area to be printed of a transparent receiver sheet, a longitudinal dye ribbon, means for positioning the longitudinal dye ribbon so that a first dye coat overlies and is in contact with the area of receiver sheet to be printed, a laser, means for projecting the laser through the receiver sheet into the dye coat to produce thermal stimuli therein, means for causing the laser to move in raster pattern to cause dye transfer to the receiver sheet and means for causing movement of the dye ribbon in a direction transverse to said area of the receiver sheet to position a second dye coat over said area to be printed, wherein the dye ribbon comprises a substrate supporting at least two dye coats extending along the ribbon and a reflective layer interposed between the substrate and the dye coats.

4. Apparatus according to claim 3 wherein the means for positioning the longitudinal dye ribbon is a cartridge/cassette comprising a housing, a feed spool rotatably mounted in the housing and having wound thereon the longitudinal dye ribbon bearing at least two dye coats and a take-up spool rotatably mounted in the housing and having affixed thereto the free end of the ribbon.

5. Apparatus according to claim 3 wherein the reflective layer has a reflectance of at least 15%.

* * * * *